US011067365B2

(12) United States Patent
Roberson

(10) Patent No.: US 11,067,365 B2
(45) Date of Patent: Jul. 20, 2021

(54) MULTIPLE ANGLE OFFSET OPTIC MOUNT

(71) Applicant: Arisaka LLC, Apex, NC (US)

(72) Inventor: William Roberson, Apex, NC (US)

(73) Assignee: Arisaka LLC, Apex, NC (US)

( * ) Notice: Subject to any disclaimer, the term of this patent is extended or adjusted under 35 U.S.C. 154(b) by 0 days.

(21) Appl. No.: 16/998,095

(22) Filed: Aug. 20, 2020

(65) Prior Publication Data

US 2021/0055078 A1 Feb. 25, 2021

Related U.S. Application Data

(60) Provisional application No. 62/889,694, filed on Aug. 21, 2019.

(51) Int. Cl.
*F41G 11/00* (2006.01)
*F41G 1/387* (2006.01)

(52) U.S. Cl.
CPC ..... *F41G 1/387* (2013.01); *F41G 11/003* (2013.01)

(58) Field of Classification Search
CPC ..... F41G 1/387; F41G 11/003
USPC ..... 42/111, 124–127
See application file for complete search history.

(56) References Cited

U.S. PATENT DOCUMENTS

| | | | | |
|---|---|---|---|---|
| 5,606,818 A * | 3/1997 | Hardee | F41G 11/003 42/124 |
| D663,006 S * | 7/2012 | Storch | D22/108 |
| RE45,724 E | 10/2015 | Dueck | |
| 9,441,915 B2 | 9/2016 | Zimmer | |
| 10,030,935 B1 | 7/2018 | Ding et al. | |

FOREIGN PATENT DOCUMENTS

DE 202020106434 U1 * 12/2020 ..... G02B 23/00

* cited by examiner

*Primary Examiner* — Reginald S Tillman, Jr.
(74) *Attorney, Agent, or Firm* — F. Wayne Thompson, Jr.; Asgaard Patent Services, LLC

(57) ABSTRACT

An offset optic mount can be detachably mounted at its proximal end to an accessory rail of a firearm in a cantilevered fashion with its distal end extending laterally from the firearm. An offset optic mount includes: a base and a clamp member on the proximal end, the base is adapted to be mounted to the accessory rail by the clamp member; an optic adapter plate on the distal end, the optic adapter plate is configured so that an optical sight can be attached thereto, the optic adapter plate is offset at an angle relative to the longitudinal axis of the base; and a stem adapted to connect the optic adapter plate to the base, the stem is a reversable piece used to set and change the offset angle of the optic adapter plate relative to the longitudinal axis of the base.

12 Claims, 9 Drawing Sheets

MULTIPLE ANGLE OFFSET OPTIC MOUNT

CROSS REFERENCE TO RELATED APPLICATION

This application claims the benefit of U.S. Provisional Application Ser. No. 62/889,694, which was filed on Aug. 21, 2019, the entirety of which is incorporated herein by reference.

TECHNICAL FIELD

This disclosure relates to implementations of an optic mount adapted to laterally offset an attached optical sight from the top of a firearm receiver or handguard.

BACKGROUND

Shooters often use rifles to engage targets at varying ranges. Often, shooters will use a particular sighting system based on the expected target engagement range. In general, telescopic sights (i.e., scopes) provide superior performance at longer ranges (beyond 200 yards), but non-magnified electronic sights (e.g., a reflex sight) can be more effective for close-range target engagements (inside 200 yards). Rifles equipped with a telescopic sight are often equipped with an alternate, or "back up", sighting system for use in the event that the telescopic sight becomes damaged or otherwise unusable. In some instances, the alternate sighting system is a set of folding iron sights that can be flipped up for use once the telescopic sight is removed. Offset sighting systems also exist, and include iron sights and non-magnified electronic sights. These offset sighting systems provide either iron sights or a non-magnified electronic sight positioned to either side of the telescopic sight. These laterally offset sighting systems can be used without the telescopic sight being removed and can be transitioned to by rotating the firearm until the alternate sighting system is positioned for aiming.

However, prior art offset optic mounts have several disadvantages. First, they offer little or no flexibility in regards to mounting position. This limits the user's ability to select a desired eye relief for the offset electronic sight. Second, they offer little or no flexibility in regards to the offset angle afforded the attached electronic sight. This can inhibit use of the electronic sight with telescopic sights that are large in diameter or have protruding turrets that would obstruct a user's view through the offset electronic sight. Third, prior art offset optic mounts may not place the centerline of the attached electronic sight at the same, or similar, height over bore as the telescopic sight. This slows transitions between sighting systems.

Accordingly, it can be seen that needs exist for the offset optic mount disclosed herein. It is to the provision of an offset optic mount configured to address these needs, and others, that the present invention is primarily directed.

SUMMARY OF THE INVENTION

An offset optic mount can be detachably mounted at its proximal end to an accessory rail of a firearm in a cantilevered fashion with its distal end extending laterally from the firearm. The offset optic mount, and any attached optical sight, can be used in conjunction with a telescopic sight and can be mounted on the same accessory rail as the telescopic sight. Further, the offset optic mount can be configured by the user to offset the attached optical sight at one of two different angles.

An example offset optic mount includes: a base and a clamp member on the proximal end, the base is adapted to be mounted to the accessory rail by the clamp member; an optic adapter plate on the distal end, the optic adapter plate is configured so that an optical sight can be attached thereto, the optic adapter plate is offset at an angle relative to the longitudinal axis of the base; and a stem adapted to connect the optic adapter plate to the base, the stem is a reversable piece used to set and change the offset angle of the optic adapter plate relative to the longitudinal axis of the base.

In some implementations, the stem can be fixed in two orientations between the base and the optic adapter plate, each orientation of the stem changes the offset angle of the optic adapter plate relative to the longitudinal axis of the base.

BRIEF DESCRIPTION OF THE DRAWINGS

Like reference numerals refer to corresponding parts throughout the several views of the drawings.

DETAILED DESCRIPTION

Figure 1:
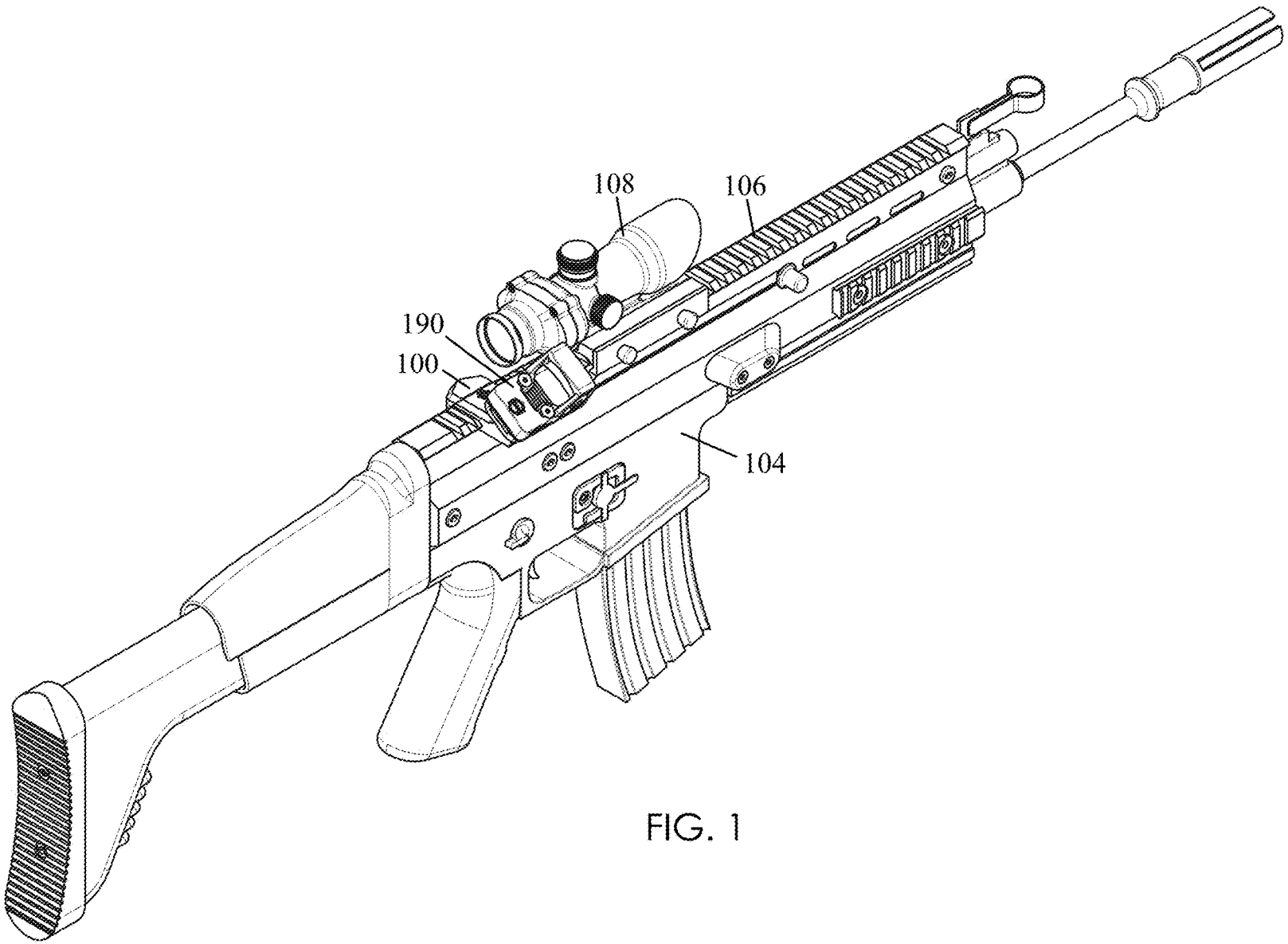
FIG. 1 illustrates a perspective view of an offset optic mount according to the principles of the present disclosure mounted to the accessory rail of a modern sporting rifle.

FIGS. 1-3 and 5-8 illustrate an example offset optic mount 100 according to the principles of the present disclosure. As shown in FIG. 1, the offset optic mount 100 can be mounted to an accessory rail 106 (e.g., a MIL-STD-1913 rail) extending along the top of a receiver or handguard of a modern sporting rifle 104 (e.g., an AR-15/M4 style firearm) and is adapted to laterally offset an attached optical sight 190 from the accessory rail 106. The offset optic mount 100, and attached optical sight 190, can be used in conjunction with a telescopic sight 108 and can be mounted on the same accessory rail 106 as the telescopic sight 108. Further, the offset optic mount 100 can be configured by the user to offset the attached optical sight 190 at one of two different angles. In this way, for example, the offset optic mount 100 can be used to position the attached optical sight as close as is possible to the telescopic sight 108 without the view through the optical sight 190 being obstructed by the body or a turret of the telescopic sight 108.

FIGS. 1-3 and 5-8 illustrate an offset optic mount 100 comprising: a clamp member 110, a base 120, an optic adapter plate 140, and a stem 130 adapted to connect the optic adapter plate 140 to the base 120.

As shown in FIG. 1, the offset optic mount 100 is detachably mounted at its proximal end (i.e., the base 110) to an accessory rail 106 of a firearm 104 in a cantilevered fashion with its distal end (i.e., the optic adapter plate 140) extending laterally from the firearm 104. The offset optic mount 100 is mounted to the accessory 106 rail by a clamp member 110 that is fastened to the base 120 by a bolt 122. The base 120 has a bottom portion 124 adapted to receive MIL-STD-1913 rail 106. The clamp member 110 and base 120 have opposed contact faces 112, 126 which abut against the inclined faces of the MIL-STD-1913 rail 106 to secure the base 120 of the offset optic mount 100 to the MIL-STD-1913 rail 106.

The optic adapter plate 140 of the offset optic mount 100 is configured so that an optical sight (e.g., optical sight 190) can be attached thereto. The optic adapter plate 140 has a top 142 adapted to interface with the base 192 of an optical sight 190 and a bottom 144 adapted for attachment to the stem 130 (see, e.g., FIGS. 5 and 6). The optic adapter plate 140 includes two or more openings 146 therein that align with openings in the base 192 of the optical sight 190. In this way, threaded fasteners (e.g., screws) can be used to secure an optical sight 190 to the top 142 of the optic adapter plate 140.

In general, the optic adapter plate 140 shown in the illustrations is configured so that an Aimpoint® Micro optical sight, or another optical sight having a compatible base, can be attached thereto. However, it should be understood that an optic adapter plate 140 could be configured so that another non-magnified optical sight can be attached thereto. Other example non-magnified optical sights include, but are not limited to, a DOCTER® red dot sight, a Leupold® Deltapoint, a Trijicon RMR®, a SIG SAUER® ROMEO1, or another non-magnified optical sight having a similar foot print that is currently known or developed in the future.

Figure 5:
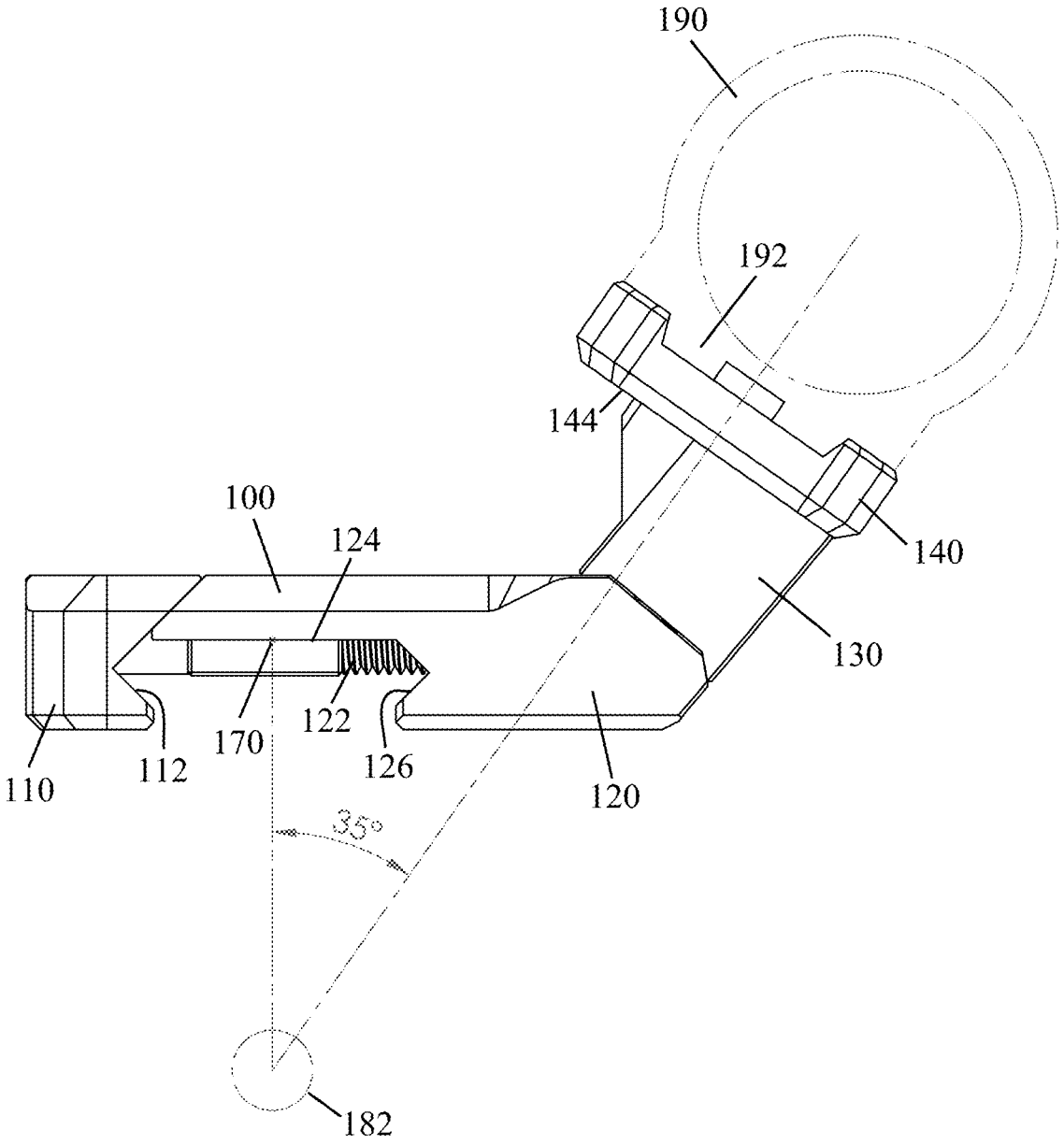
FIG. 5 illustrates a rear side view of the offset optic mount shown in FIG. 2, wherein the offset optic mount is configured for a 35-degree offset angle.
Figure 6:
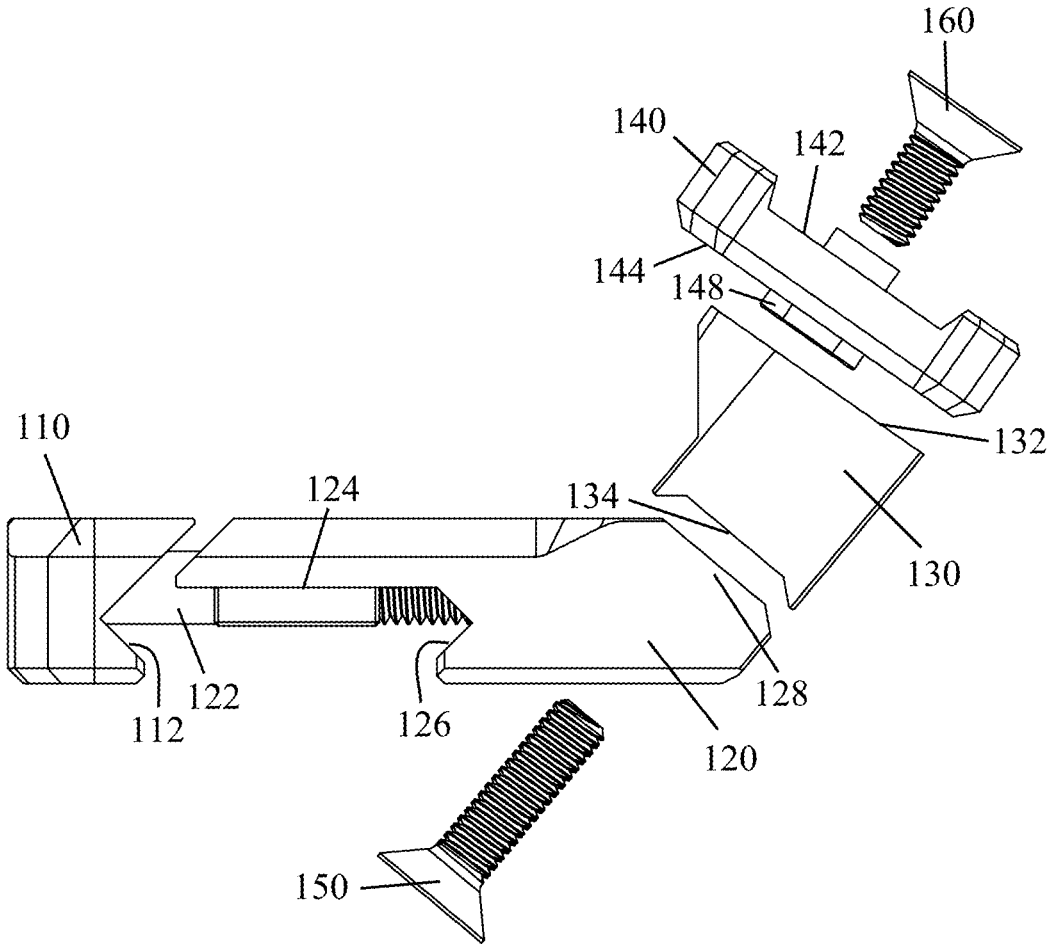
FIG. 6 illustrates an exploded view of the offset optic mount shown in FIG. 5.
Figure 7:
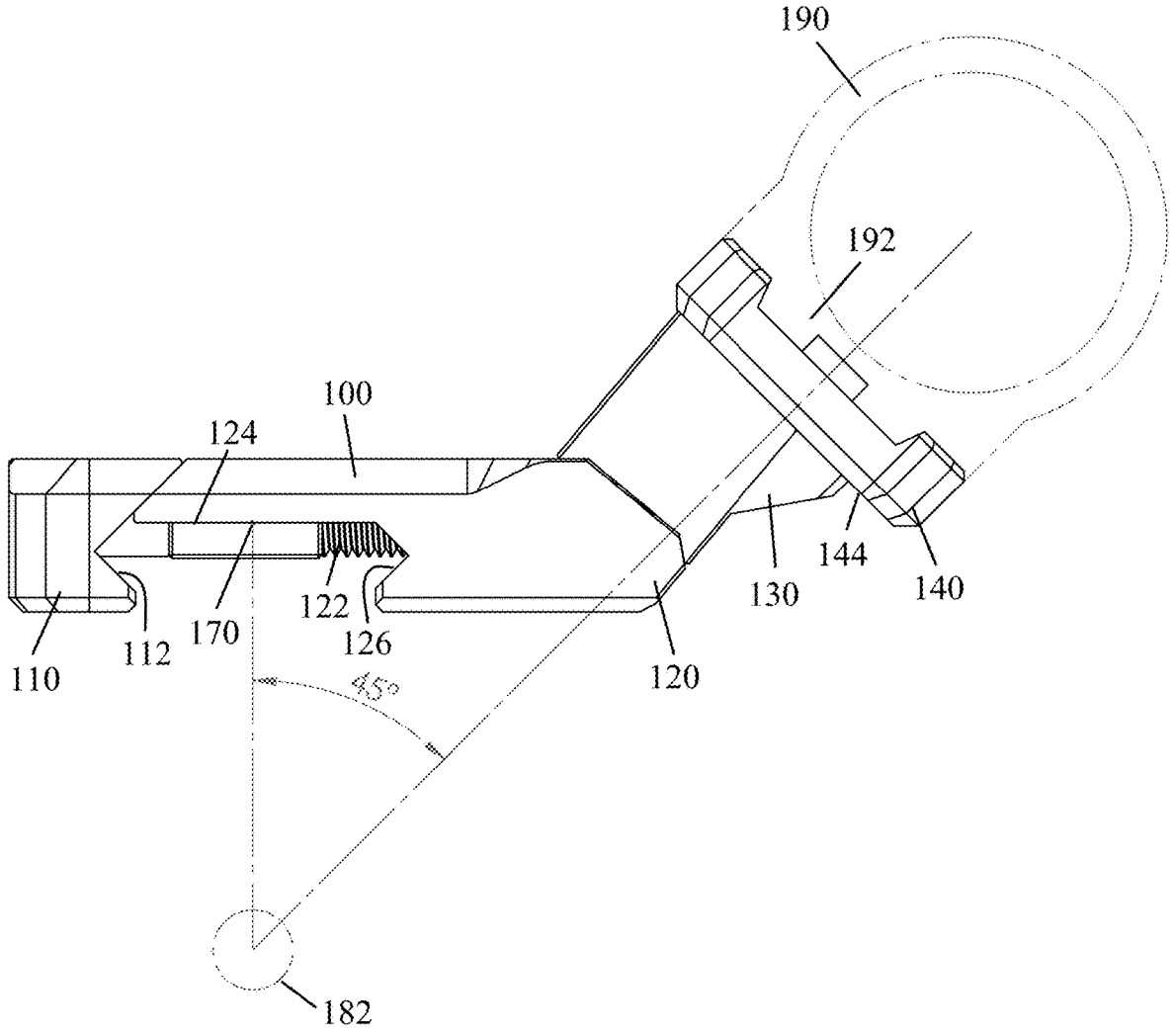
FIG. 7 illustrates another rear side view of the offset optic mount shown in FIG. 2, wherein the offset optic mount is configured for a 45-degree offset angle.
Figure 8:
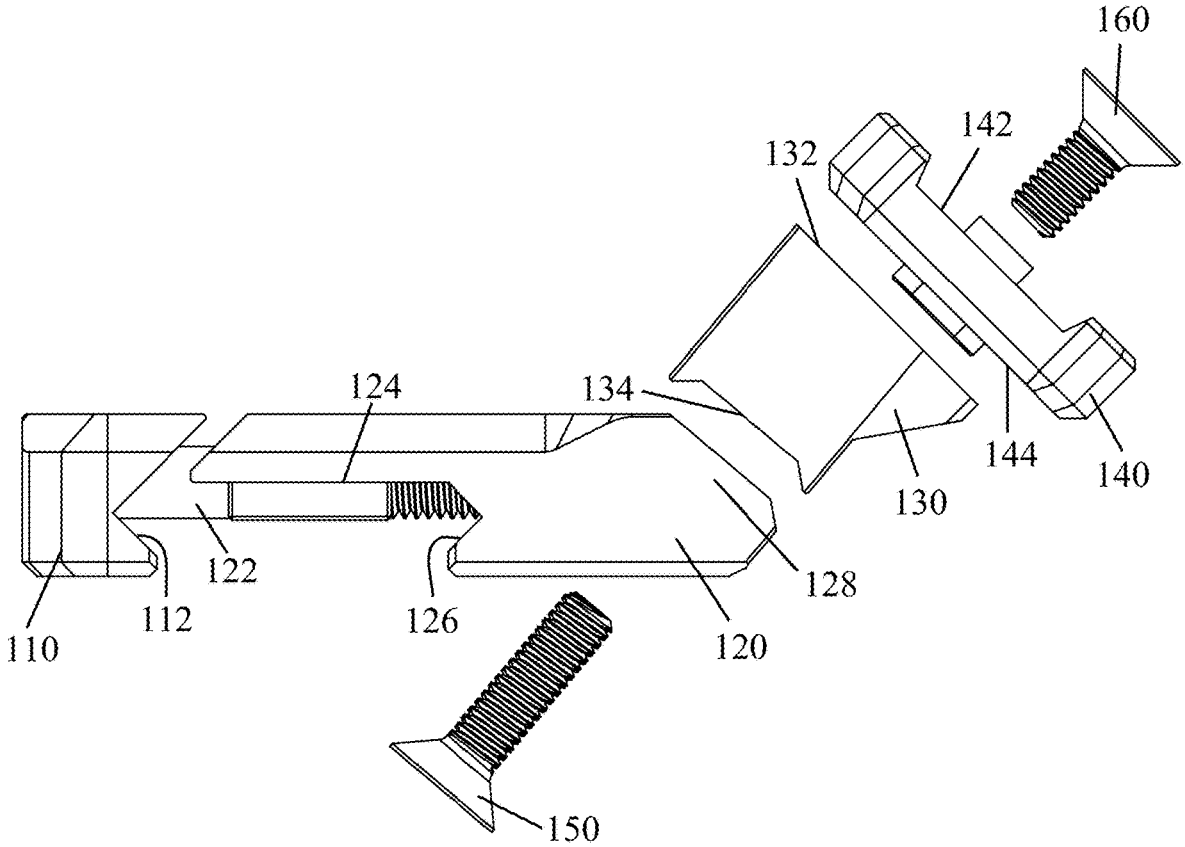
FIG. 8 illustrates an exploded view of the offset optic mount shown in FIG. 7.

As shown best in FIGS. 5 and 7, the stem 130 of the offset optic mount 100 is a reversable piece used to set and change the offset angle of the optic adapter plate 140, and the attached optical sight 190. The stem 130 can be fixed in two orientations between the base 120 and the optic adapter plate 140 of the offset optic mount 100. As shown in FIG. 5, positioning the stem 130 in a first orientation offsets the optic adapter plate 140 at a first angle (i.e., 35-degrees) relative to the longitudinal axis of the base 120. As shown in FIG. 7, positioning the stem 130 in a second orientation offsets the optic adapter plate 140 at a second angle (i.e., 45-degrees) relative to the longitudinal axis of the base 120. The longitudinal axis 170 of the base 120 is parallel to the longitudinal axis of the barrel bore 182. The longitudinal axis of the barrel bore 182 is the origin of the 35-degree offset angle shown in FIG. 5 and the 45-degree offset angle shown in FIG. 7.

While the example offset optic mount 100 is shown to offset the optic adapter plate 140, and any attached optic, at 35-degrees and 45-degrees, it should be understood that alternate embodiments of the offset optic mount 100 could be configured to offset the optic adapter plate 140 at an angle ranging between 30 and 50 degrees, inclusive of 30 and 50 degrees.

Figure 9:
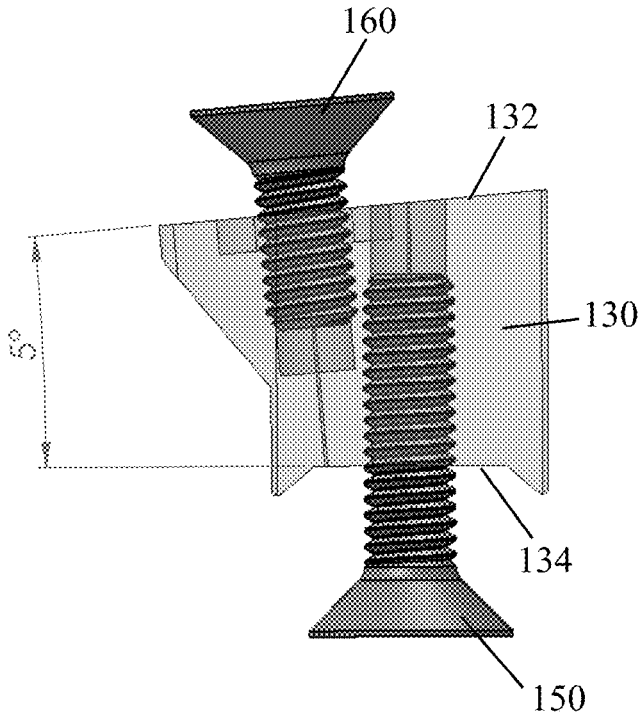
FIG. 9 illustrates an example stem of the offset optic mount shown in FIG. 2.

As shown in FIGS. 5, 7 and 9, the stem 130 includes a top surface 132 adapted to interface with the bottom 144 of the optic adapter plate 140 and a bottom surface 134 adapted to interface with an offset portion 128 of the base 120. There is a 5-degree difference between the top surface 132 and the bottom surface 134 of the stem 130 (see FIG. 9). This 5-degree difference between the top and bottom surfaces 132, 134 of the stem 130 causes the orientation of the stem 130 to set the offset angle of the optic adapter plate 140 relative to the base 120 (see, e.g., FIGS. 5 and 7). Or, put another way, the 5-degree difference between the top and bottom surfaces 132, 134 of the stem 130 facilitates the 10-degree difference between the first and second orientations of the stem 130.

Although not shown, in some implementations, the stem 130 could be machined to have a different angle (i.e., other than 5-degrees) between its top and bottom surfaces 132, 134. In this way, the range of offset provided by the offset optic mount 100 can be increased or decreased. As a non-limiting example, if the angle between the top and bottom surfaces 132, 134 of the stem 130 is increased to 7.5-degrees, the stem 130 would provide a 15-degree difference between orientations. In some implementations, the angle between the top and bottom surfaces 132, 134 of the stem 130 can range between 2.5 and 10 degrees, depending on the needs of the end user.

Figure 2:
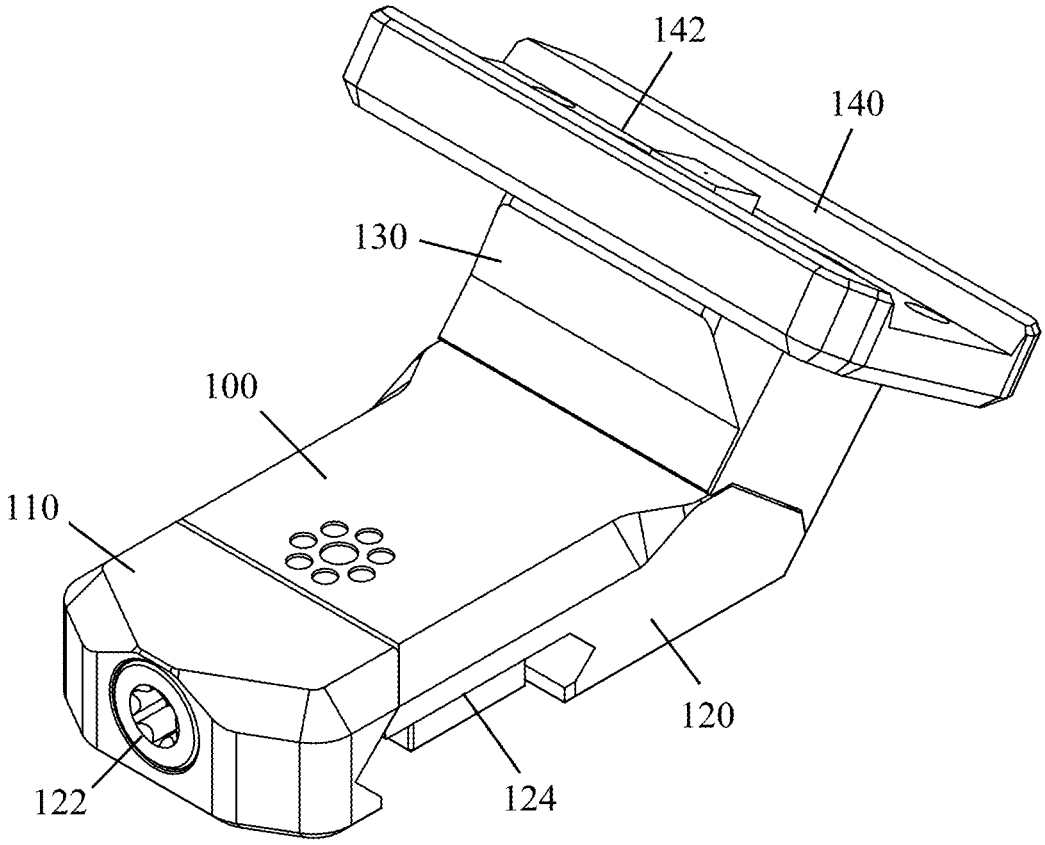
FIG. 2 illustrates an isometric view of an example offset optic mount according to the principles of the present disclosure.
Figure 3:
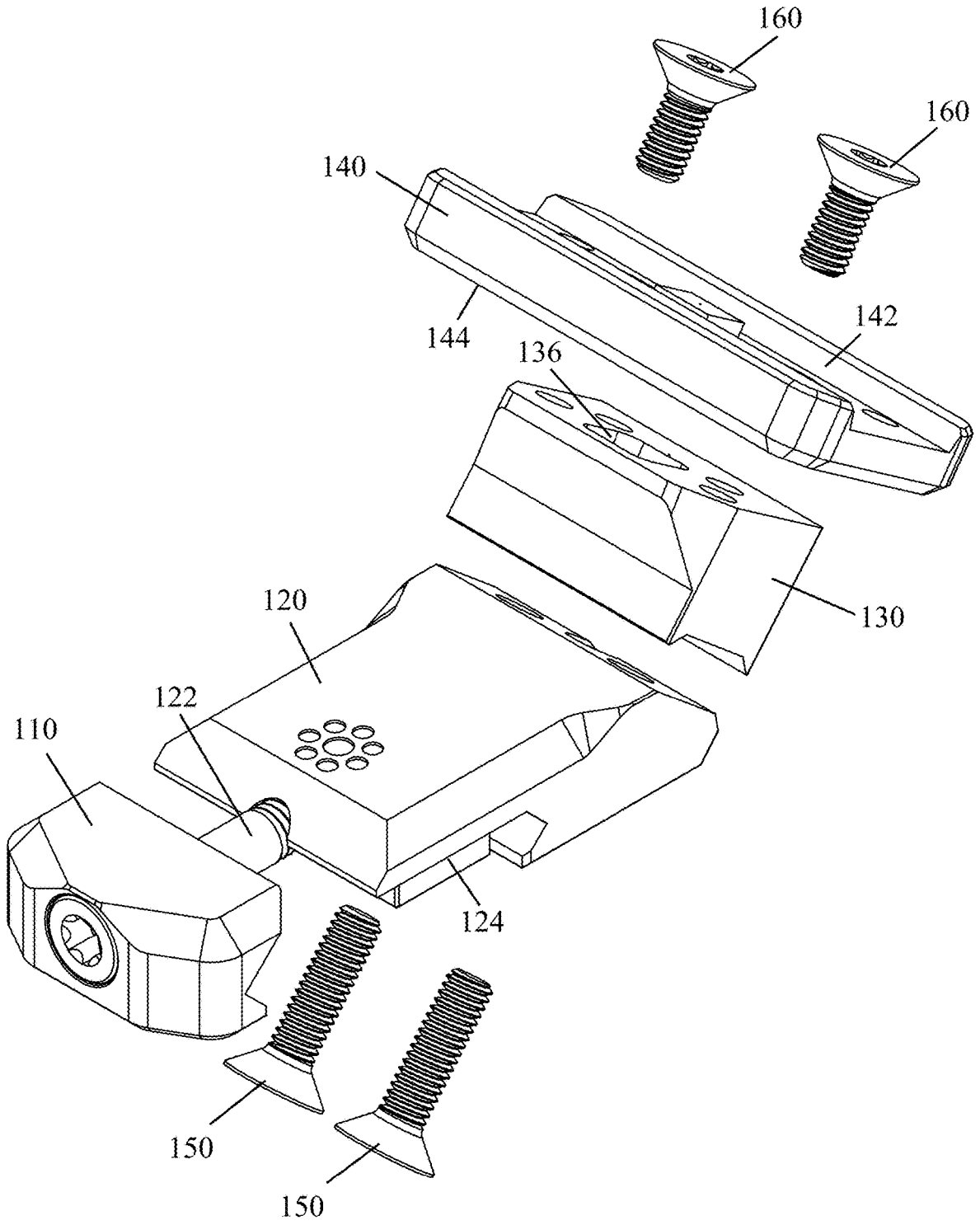
FIG. 3 illustrates an exploded view of the offset optic mount shown in FIG. 2.
Figure 4A:
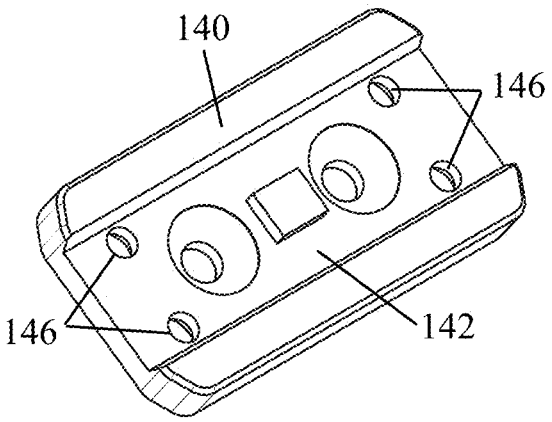
FIGS. 4A and 4B illustrate isometric views of an example optic adapter plate of the offset optic mount shown in FIG. 2.
Figure 4B:
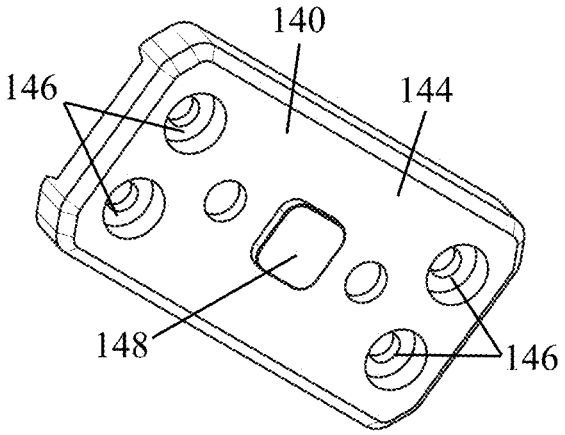

As shown in FIGS. 2 and 4, in some implementations, the top surface 132 of the stem 130 includes a recess 136 therein that is configured to receive a recoil lug 148 extending from the bottom 144 of the optic adapter plate 140. The recoil lug 148 is a rectangular projection configured to snugly fit within the recess 136 of the stem 134. In this way, while the optic adapter plate 140 is attached to the stem 130, the recoil lug 148 prevents the optic adapter plate 140 from sliding back and forth due to the incidental vibrations associated with the discharge of a firearm.

The stem 130 is secured between the base 120 and the optic adapter plate 140 by threaded fasteners 150, 160. More specifically, in some implementations, the stem 130 is attached to the base 120 by two fasteners 150 and the optic adapter plate 140 is attached to the stem 130 by two additional fasteners 160.

During assembly, the stem 130 is aligned with the base 120 of the offset optic mount 100 in one of two orientations (see, e.g., FIGS. 5 and 7). The orientation of the stem 130 being selected by the user based on the offset angle desired for an attached optical sight 190. Then, the optic adapter plate 140 is secured to the stem 130. Depending on the optical sight being attached to the optic adapter plate 140, the optical sight may be secured to the optic adapter plate 140 before or after it's attached to the stem 130 of the offset optic mount 100.

The base 120, the optic adapter plate 140, and the stem 130 of the offset optic mount 100 are machined from a strong, light weight metal, such as aluminum, although other suitable materials may be used. The clamp member 110 of the offset optic mount 100 is cast or machined from a strong, light weight metal, such as steel or aluminum, although other suitable materials may be used. The fasteners 150, 160 are of conventional design and constructed of conventional materials.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An offset optic mount that can be detachably mounted at its proximal end to an accessory rail of a firearm in a cantilevered fashion with its distal end extending laterally from the firearm, the offset optic mount comprising:

a base and a clamp member on the proximal end, the base is adapted to be mounted to the accessory rail by the clamp member;

an optic adapter plate on the distal end, the optic adapter plate is configured so that an optical sight can be attached thereto, the optic adapter plate is offset at an angle relative to the longitudinal axis of the base; and a stem adapted to connect the optic adapter plate to the base, the stem is a reversable piece used to set and change the offset angle of the optic adapter plate relative to the longitudinal axis of the base.

2. The offset optic mount of claim 1, wherein the stem can be fixed in two orientations between the base and the optic adapter plate, each orientation of the stem changes the offset angle of the optic adapter plate relative to the longitudinal axis of the base.

3. The offset optic mount of claim 1, wherein the stem includes a top surface adapted to interface with a bottom of the optic adapter plate and a bottom surface adapted to interface with an offset portion of the base, the top surface lies at an angle between 2.5 and 10 degrees with respect to the bottom surface.

4. The offset optic mount of claim 3, wherein the top surface of the stem includes a recess therein that is configured to receive a recoil lug extending from the bottom of the optic adapter plate.

5. An offset optic mount that can be detachably mounted at its proximal end to an accessory rail of a firearm in a cantilevered fashion with its distal end extending laterally from the firearm, the offset optic mount comprising:

a base and a clamp member on the proximal end, the base is adapted to be mounted to the accessory rail by the clamp member;

an optic adapter plate on the distal end, the optic adapter plate is configured so that an optical sight can be attached thereto, the optic adapter plate is offset at an angle relative to the longitudinal axis of the base; and a stem adapted to connect the optic adapter plate to the base, the stem is a reversable piece used to set the offset angle of the optic adapter plate relative to the longitudinal axis of the base;

wherein the stem can be fixed in two orientations between the base and the optic adapter plate; when the stem is in a first orientation, the optic adapter plate is offset at a first angle relative to the longitudinal axis of the base; and when the stem is in a second orientation, the optic adapter plate is offset at a second angle relative to the longitudinal axis of the base.

6. The offset optic mount of claim 5 wherein the first angle and the second angle are not the same.

7. The offset optic mount of claim 5, wherein the stem includes a top surface adapted to interface with a bottom of the optic adapter plate and a bottom surface adapted to interface with an offset portion of the base, the top surface lies at an angle between 2.5 and 10 degrees with respect to the bottom surface.

8. The offset optic mount of claim 7, wherein the top surface of the stem includes a recess therein that is configured to receive a recoil lug extending from the bottom of the optic adapter plate.

9. An offset optic mount that can be detachably mounted at its proximal end to an accessory rail of a firearm in a cantilevered fashion with its distal end extending laterally from the firearm, the offset optic mount comprising:

a base and a clamp member on the proximal end, the base is adapted to be mounted to the accessory rail by the clamp member;

an optic adapter plate on the distal end, the optic adapter plate is configured so that an optical sight can be attached thereto, the optic adapter plate is offset at an angle relative to the longitudinal axis of the base; and a stem adapted to connect the optic adapter plate to the base, the stem can be fixed in two orientations between the base and the optic adapter plate, positioning the stem in a first orientation offsets the optic adapter plate at a first angle relative to the longitudinal axis of the base, and positioning the stem in a second orientation offsets the optic adapter plate at a second angle relative to the longitudinal axis of the base.

10. The offset optic mount of claim 9 wherein the first angle and the second angle are not the same.

11. The offset optic mount of claim 9, wherein the stem includes a top surface adapted to interface with a bottom of the optic adapter plate and a bottom surface adapted to interface with an offset portion of the base, the top surface lies at an angle between 2.5 and 10 degrees with respect to the bottom surface.

12. The offset optic mount of claim 11, wherein the top surface of the stem includes a recess therein that is configured to receive a recoil lug extending from the bottom of the optic adapter plate.

* * * * *